US006898155B1

(12) United States Patent
Norman

(10) Patent No.: US 6,898,155 B1
(45) Date of Patent: May 24, 2005

(54) PROGRAMMABLE REMINDER DEVICE HAVING MULTI-EVENT CAPACITY

(75) Inventor: Cary A. Norman, Monterey, CA (US)

(73) Assignee: Can-Tron, Monterey, CA (US)

( * ) Notice: Subject to any disclaimer, the term of this patent is extended or adjusted under 35 U.S.C. 154(b) by 0 days.

(21) Appl. No.: 09/516,711

(22) Filed: Mar. 1, 2000

(51) Int. Cl.[7] ..... G04L 23/00; G04F 8/00; H01H 43/00

(52) U.S. Cl. ..... 368/107; 368/69; 368/109; 368/188; 307/116

(58) Field of Search ..... 368/71–113, 315–321, 368/69, 70, 224, 230, 278, 261, 232; 307/116; 200/DIG. 2

(56) References Cited

U.S. PATENT DOCUMENTS 3,983,690 A * 10/1976 McClintock ..... 368/69
4,063,111 A * 12/1977 Dobler et al. ..... 307/116
4,064,688 A * 12/1977 Sasaki et al. ..... 368/69
4,067,187 A * 1/1978 Sekiya et al. ..... 368/188
4,078,376 A * 3/1978 Freeman ..... 368/73
4,090,353 A * 5/1978 Maeda et al. ..... 368/188
4,228,645 A * 10/1980 Nomura ..... 368/250
4,301,524 A * 11/1981 Koepp et al. ..... 368/261
4,322,833 A * 3/1982 Husted ..... 368/69
4,459,036 A * 7/1984 Sado et al. ..... 368/251
4,589,779 A * 5/1986 Hatta et al. ..... 368/74
4,769,797 A * 9/1988 Murakami ..... 368/111
4,785,433 A * 11/1988 Bush et al. ..... 368/109
4,855,971 A * 8/1989 Meisner et al. ..... 368/188
4,860,267 A 8/1989 Herrington et al. ..... 368/10
5,016,230 A 5/1991 Seifers et al. ..... 368/10
5,088,072 A * 2/1992 Fitzmorris ..... 368/69
5,243,579 A * 9/1993 Potthof ..... 368/107
5,453,960 A * 9/1995 Teres et al. ..... 368/69
5,602,802 A 2/1997 Leigh-Spencer et al. ..... 368/10
5,742,564 A * 4/1998 Kuschel et al. ..... 368/69
5,910,931 A 6/1999 Pettyjohn ..... 368/251
5,940,349 A * 8/1999 Stewart ..... 368/69
5,995,455 A * 11/1999 Kutosky ..... 368/250
6,091,326 A * 7/2000 Castellano ..... 368/278
6,104,674 A * 8/2000 Emoff et al. ..... 368/109
6,369,698 B1 * 4/2002 Valente ..... 340/309.15

* cited by examiner

*Primary Examiner*—Kamand Cuneo
*Assistant Examiner*—Jeanne-Marguerite Goodwin
(74) *Attorney, Agent, or Firm*—Law Offices of Terry McHugh

(57) ABSTRACT

A portable multi-event reminder device includes a battery-powered electrical timer circuit that is programmable with respect to selecting at least two overlapping time periods, so as to generate prompts for at least two functionally related but time-independent events. A solitary two-state switch is the sole input device employed by a user to provide the desired timing programming. The timer circuit is configured to generate a first electrical reminder signal upon expiration of the first selected time period and to generate a second electrical reminder signal upon expiration of the second selected time period. The reminder signals activate one or more sensory alerts that generate human-perceivable alerts for prompting a user.

8 Claims, 5 Drawing Sheets

PROGRAMMABLE REMINDER DEVICE HAVING MULTI-EVENT CAPACITY

TECHNICAL FIELD

The invention relates generally to programmable electronic reminder devices and more particularly to electronic devices that can be programmed to provide multiple event alerts, such as a first alert that provides a reminder to perform an at home medical task and a second alert that provides a reminder regarding a visit to a medical professional.

BACKGROUND ART

Software programs which are intended to increase the day-today organization of users have become highly sophisticated. Calendar programs enable users to enter daily scheduling and event information for a range of years. Contact programs enable users to enter addressing data and other information relating to thousands of persons. Calendar and contact programs may be executed on desktop computers or portable electronic devices, such as personal digital assistants (PDAs).

Perhaps the only concern with these organizational programs is that they rely upon the organizational skills of a user and upon the frequency at which they are accessed by the user. Scheduled events must be entered into a PDA in order for the device to operate as an aid in providing a reminder of the events. Moreover, even if information of the event is entered into the PDA, the device may not provide the desired reminder, if the device is only infrequently accessed by the user.

Timing devices that provide a reminder of a specific event are available. U.S. Pat. No. 5,016,230 to Seifers et al. describes a timing device that is incorporated into the cap of a container of medicine, in order to provide a reminder that it is time to take medication. The timing device includes an oscillator and chained CMOS flip-flop devices, with an audible or visual alarm that signals after a predefined elapsed time period. The device may be reset manually or may be automatically reset. When the device is reset, it begins the timing cycle again, so that the next reminder will be triggered.

A device for measuring a longer period of time is described in U.S. Pat. No. 4,860,267 to Herrington et al. The Herrington et al. device provides a reminder to empty a waste container. The device is attached to the waste container or is integrated into the container. A clock-timing circuit cooperates with an audible or visual signaling mechanism to alert a user that it is time to prepare waste materials for collection. Thus, if non-recyclable waste material is picked up on a designated day of the week, a first device may be attached to a container of the non-recyclable waste. Then, if recyclable material is picked up once every two weeks, a second device is attached to the container of the recyclable material.

An even longer period of time is measured by the automobile inspection reminder device described in U.S. Pat. No. 5,910,931 to Pettyjohn. This device is adjustable to set its activation time. A microswitch is provided for each of the twelve months of a year, so as to make it relatively easy for a user to set the correct inspection due date in memory. Then, approximately one month before the due date of the automobile inspection, a light emitting diode (LED) flashes as a reminder. After the inspection, the device can be set to the next inspection due date.

As compared to PDAs and other highly sophisticated computational systems, the event-specific devices of Seifers et al., Herrington et al. and Pettyjohn have the advantage of providing reminders without requiring any activity by the users after the initial setup. However, these devices may be inadequate for reminding users of functionally related but time-independent events. As one example, a user may wish to be reminded every thirty days to administer flea repellant or heart worm medication for a pet and to be separately reminded every six months to schedule a veterinarian checkup for the pet. This would require two of the devices described in the prior art.

A more important example of the need for reliable reminders of functionally related but time-independent events involves breast health. While the majority of breast lumps are not cancerous, early detection of those that are significantly increases the chances of successful treatment. The three main types of breast examinations are breast self examination (BSE), clinical breast examination (CBE) and mammography. The American Cancer Society recommends that women over the age of forty should perform BSEs on a monthly basis and have a CBE and mammogram on an annual basis. One concern is that the monthly BSE or the annual professional care will be forgotten. Another concern is that without some external prompt, an uncertain percentage of women will needlessly postpone the monthly or annual exam.

What is needed is a multi-event reminder device that is programmed to enable tracking of dissimilar but overlapping time periods and to generate a prompt for each of two or more functionally related but time-independent events.

SUMMARY OF THE INVENTION

A multi-event reminder device includes a portable housing that contains a power source, such as a battery, and an electrical timer circuit that is programmable with respect to selecting at least two overlapping time periods in which the longer time period is not necessarily a multiple of the shorter time period. Moreover, the start and end times of one period may be different than the start and end times of the other period. The timer circuit is configured to generate a first electrical reminder signal upon expiration of the first selected time period and to generate a second electrical reminder signal upon expiration of the second selected time period. The multi-event reminder device includes at least one sensory alert that is responsive to the timer circuit for generating a human-perceivable alert in response to the generated signals. Preferably, there is a one-to-one correspondence between the sensory alerts and the number of events being tracked. A reset mechanism allows a user to initialize and reinitialize the timer circuit with respect to the tracking of the two time periods.

In one embodiment, the multi-event reminder device is adapted for attachment to a metallic surface, such as the surface of a refrigerator. For example, a magnetic strip may be formed on the rear surface of the portable housing. The sensor alerts may be light sources, such as light emitting diodes (LEDs). However, other alert mechanisms, either visible, audible or tactile, may be substituted. Also in the preferred embodiment, the timer circuit includes a microprocessor.

In a preferred application, the first time period is selected on a basis of an expectation to perform a particular medical-related task, while the second time period is selected on a basis of scheduling or attending a professional medical examination. For example, the first event of concern to the user may be the monthly administration of a flea repellant to a pet, while the second event of concern may be the scheduling of an annual or biannual visit to the veterinarian. The first electrical reminder signal will be generated on a monthly basis and the second electrical reminder signal will be generated only after a number of the first electrical reminder signals. In a most preferred embodiment, the device is used to promote breast health. The first time period is based upon the menstrual cycle of the user, while the second time period is based upon the age of the user, since a person under the age of forty can safely schedule CBEs every three years and a woman over the age of forty should have a CBE and mammogram on an annual basis.

The housing of the reminder device preferably has a cylindrical "button" shape. The unit has a solitary push control and at least two alert mechanisms, such as audio transducers, lights, or vibrating units. The push control may be responsive to pressure on the face of the reminder device to operate as the sole input device for programming entries by an end user. That is, the reminder device may itself function as the push control. Then, the user can press the face of the device a specific number of times or in a specific sequence in order to set each of the alert mechanisms. For example, pressing the face of the device two times may signal that the alarm time for the first alert mechanism is to be set, while depressing the face three times signals that the second alert mechanism is to be set. Once the appropriate alert mechanism is identified, the time is entered by again pressing the face of the device a specific number of times or in a specific sequence. For example, if the user wishes the first alert mechanism to be activated at 9:00 a.m., 1:00 p.m. and 6:00 p.m., the user can set these alarm times on the first day of use. The reminder device will then provide alerts at 9:00 a.m., 1:00 p.m. and 6:00 p.m. on a twenty-four hour basis, until the user resets the device.

An advantage of the invention is that the programmable device may be personalized, such as by selecting one or more time periods on the basis of an individual's bodily cycle. Another advantage is that the device is portable. Therefore, the timer circuit may be programmed to trigger reminders for different automobile care requirements, e.g., regular oil changes, in addition to annual inspections. Yet another advantage is that the use of the microprocessor enables long time periods to be selected and accurately tracked.

DETAILED DESCRIPTION

Figure 1:
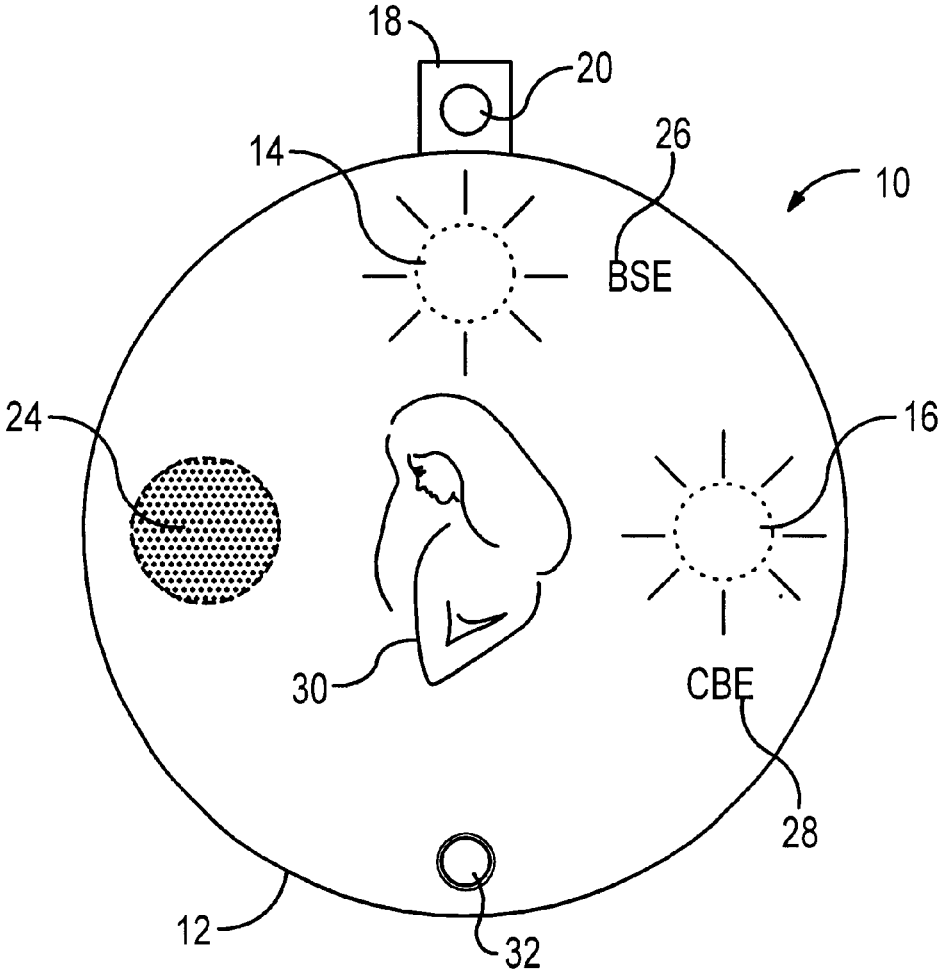
FIG. 1 is a front view of a multi-event reminder device in accordance with one embodiment of the invention.
Figure 2:
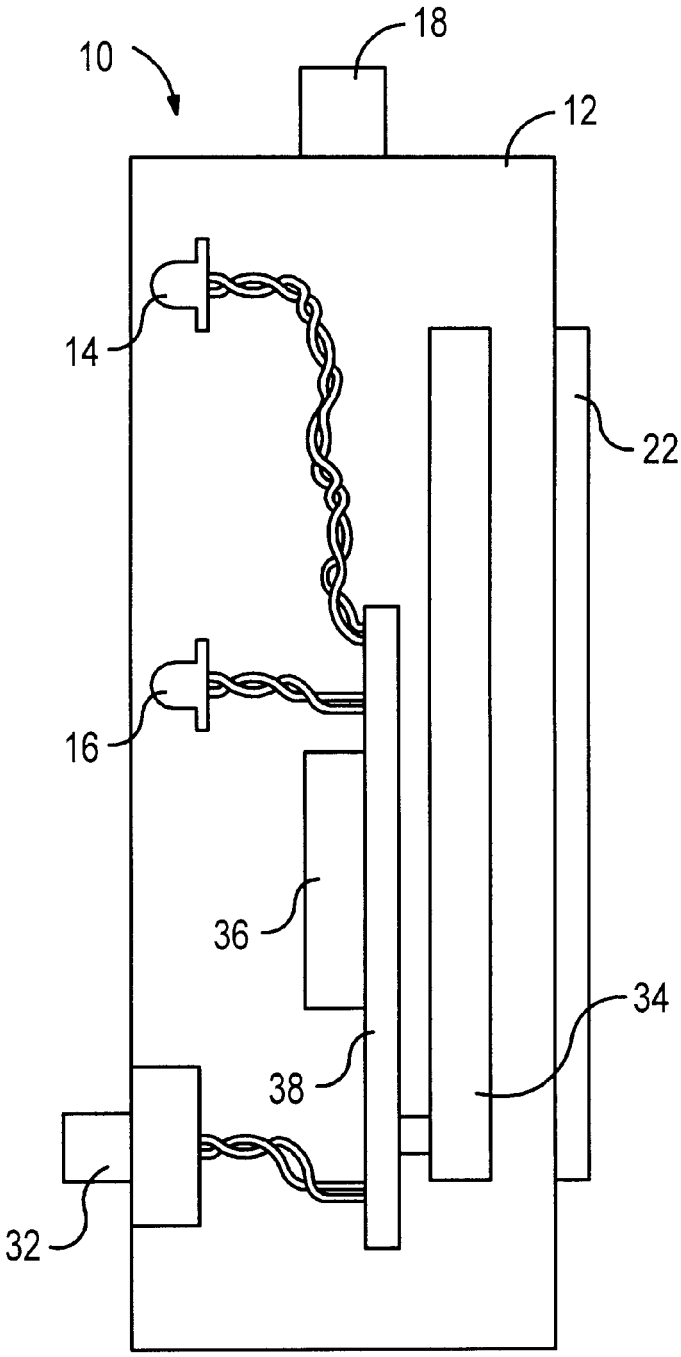
FIG. 2 is a side view of the reminder device of FIG. 1, showing internal components.

With reference to FIGS. 1 and 2, a multi-event reminder device 10 is shown as including a housing 12 formed of an opaque plastic material that allows some passage of light when one or both of two light sources 14 and 16 are activated. The dimensions of the reminder device are not critical, but preferably are such that the device is easily transported. For example, the diameter of the illustrated circular embodiment may be in the range of 25 mm to 127 mm. A projection 18 extends from the circumference of the housing 12. The projection includes an opening 20 for passage of a key chain, a nail or another means for securing or mounting the reminder device 10. Alternatively or additionally, the rear surface of the housing may include a magnetic strip 22, an adhesive strip or the like. The magnetic strip 22 allows the device to be secured to a metal surface, such as a refrigerator.

The reminder device 10 includes a number of alert mechanisms. In the embodiment of FIGS. 1 and 2, the alert mechanisms include first and second light sources 14 and 16 and an audio transducer 24. The light sources 14 and 16 may be LEDs that provide sufficient light energy to project light through the material of the housing 12. Alternatively, the housing may have openings that are aligned with the LEDs. Preferably, the alert mechanisms are activated in a manner to draw attention. For example, the LEDs may blink or the audio transducer 24 may produce a chirping sound. Particularly with the audio transducer, the activation may not be continuous. For example, three minutes of chirping may be followed by an hour of silence, with no activation between the hours of 8:00 PM and 8:00 AM.

While the embodiment of FIGS. 1 and 2 includes the two LEDs 14 and 16 and the audio transducer 24 as alert mechanisms, the reminder device 10 may have a single alert mechanism that is activated for all of the events that are considered during the programming of the device. However, the preferred embodiment includes at least as many alert mechanisms as the events of concern, although one of the events may be of the type that repeatedly occurs. This allows each alert mechanism to be labeled. In FIG. 1, the indicia on the forward surface of the device includes the designations "BSE" 26 and "CBE" 28. This particular device may be used to remind and prompt a user regarding events related to breast health. The first LED 14 may be programmed to be illuminated in accordance with the desired timing for a breast self exam (i.e., BSE). The periodicity of the activation of the first LED 14 may be based upon the individual's menstrual cycle. The second LED 16 is illuminated to remind the user that it is time to schedule or attend a medical examination, such as a clinical breast exam (i.e., CBE). The audio transducer 24 may be used if the device is not reset after a programmed time period following activation of one of the LEDs 14 and 16. Alternatively, the audio transducer may be used as an alert mechanism for a third event. The indicia on the forward face of the reminder device 10 also includes a logo 30 that is selected to identify the purpose of the device, if the user employs similar devices for other purposes (e.g., to remind the user to apply flea repellant and to schedule a veterinarian appointment for a pet).

The multi-event reminder device 10 is shown as including an exterior reset/program switch 32 that is depressible. After activation of one of the alert mechanisms, the switch 32 may be depressed in order to return the mechanism to its inactive state. Programming may include providing a code to the number of successive depressions, so that the different programmed time periods can be individually reinitialized.

While the reset/program switch 32 is shown as extending from the housing of the reminder device, this is not critical. Preferably, the switch is positioned such that the face of the housing functions as the trigger for the switch. That is, by pressing the face of the reminder device 10, the user is able to program the device.

Referring specifically to the side view of FIG. 2, the multi-event reminder device 10 is powered by a battery 34 and includes a microprocessor 36 mounted on a circuit board 38. An acceptable microprocessor is one sold by Microchip Technology Inc. under the item number PIC12C508, which is a surface mountable 4 MHz microcontroller. An acceptable battery 34 is a 3 volt lithium battery having a coin shape with a diameter of 20 mm.

Figure 3:
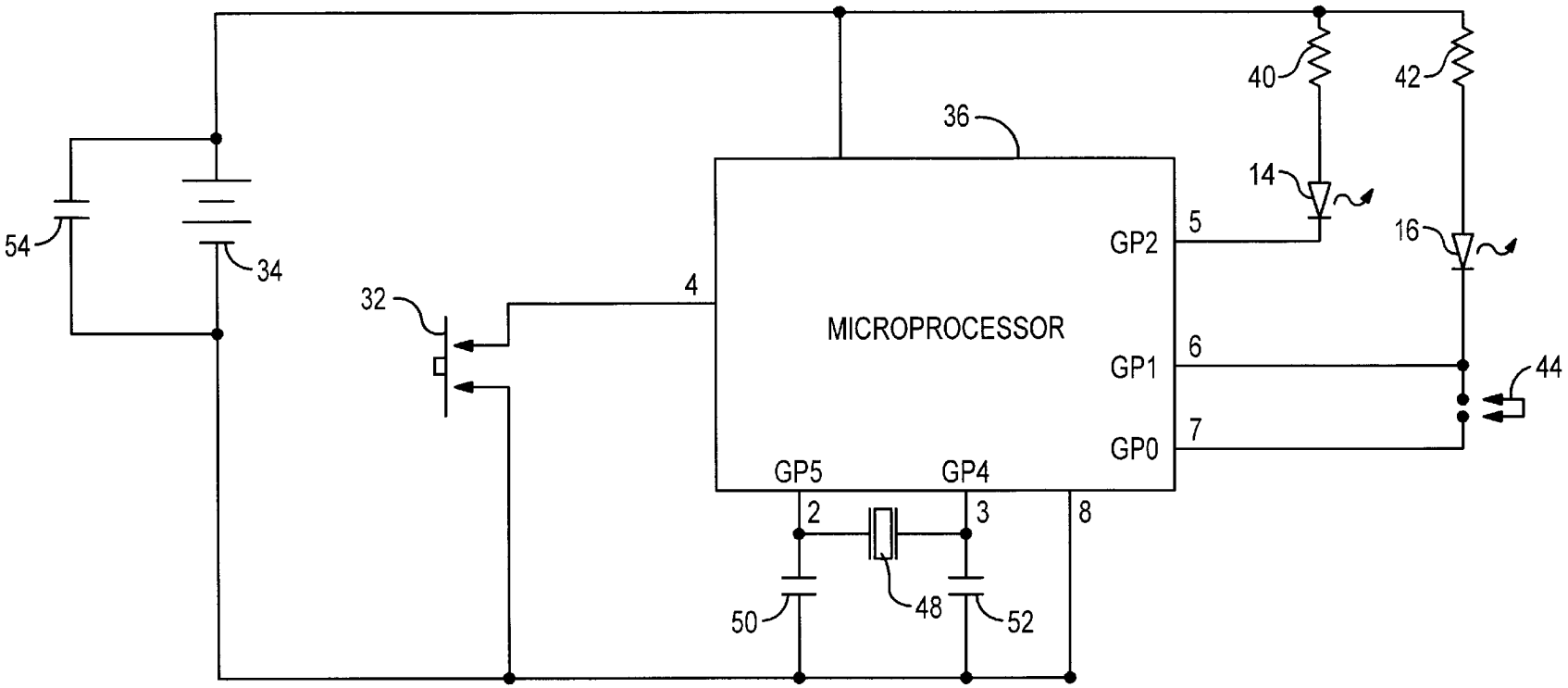
FIG. 3 is a schematic of electrical components in the reminder device of FIGS. 1 and 2.

The circuit is shown schematically in FIG. 3. The first LED 14 may emit red light, while the second LED 16 emits green light. This further distinguishes the two distinct alerts of functionally related but time-independent events. A pair of 75 ohm resistors 40 and 42 are used to control current flow through the LEDs 14 and 16. A jumper connection 44 may be used to increase the versatility of the device.

Accurate tracking of the time periods that are programmed into the microprocessor 36 is ensured by using a high quality piezo crystal 48 that is connected to a pair of 15 PF ceramic capacitors 50 and 52. The piezo crystal 48 may be a 32.768 KHz crystal, but this is not critical. A 3.3 pF capacitor 54 is connected across the battery 34. The audio transducer 24 of FIG. 1 is not shown in the schematic of FIG. 3.

In the operation of the multi-event reminder device 10 of FIGS. 1–3, the microprocessor 36 is programmed to track running of at least two time periods that overlap, but that do not necessarily bear any relationship. The events of concern are typically related, but the time periods need not be. The reset/program switch 32 can be used to initialize the sequencing. Optionally, the reset/program switch is mounted within the housing of the reminder device, so that pressure on the face of the device triggers the switch. As another possibility, there may be a one-to-one correspondence between the alert mechanisms within the device and the reset/program switch. If the reminder device includes a single switch, the user may identify a particular alert mechanism by depressing the switch a specific number of times or in a specific sequence. For example, depressing the switch two times may signal that the first alert mechanism is to be set, while three depressions may signal that the second alert mechanism is to be set. Once the alert mechanism is identified, subsequent depressions of the switch program the time or times at which the identified alert mechanism is to be activated. For example, the LED 14 may be activated at 9:00 a.m., 1:00 p.m. and 6:00 p.m. Once set, the alert mechanism is activated at the designated times each day, until the user reprograms the device.

The microprocessor 36 generates a first alert signal to the LED 14 when the first time period has expired. As a result, the LED 14 is illuminated. Optionally, the audio transducer 24 is also activated. Signaling may be a blinking of the light and/or an audible chirp. A user can reinitialize the device 10 with respect to tracking the first time period by depressing the switch 32. As an alternative or additional reset means, the microprocessor may be programmed to terminate signaling after a predetermined time period.

Following the expiration of the second programmed time period, the microprocessor 36 generates a second alert signal to the second LED 16. Again, the reset means may be manual, preprogrammed, or both.

Figure 4:
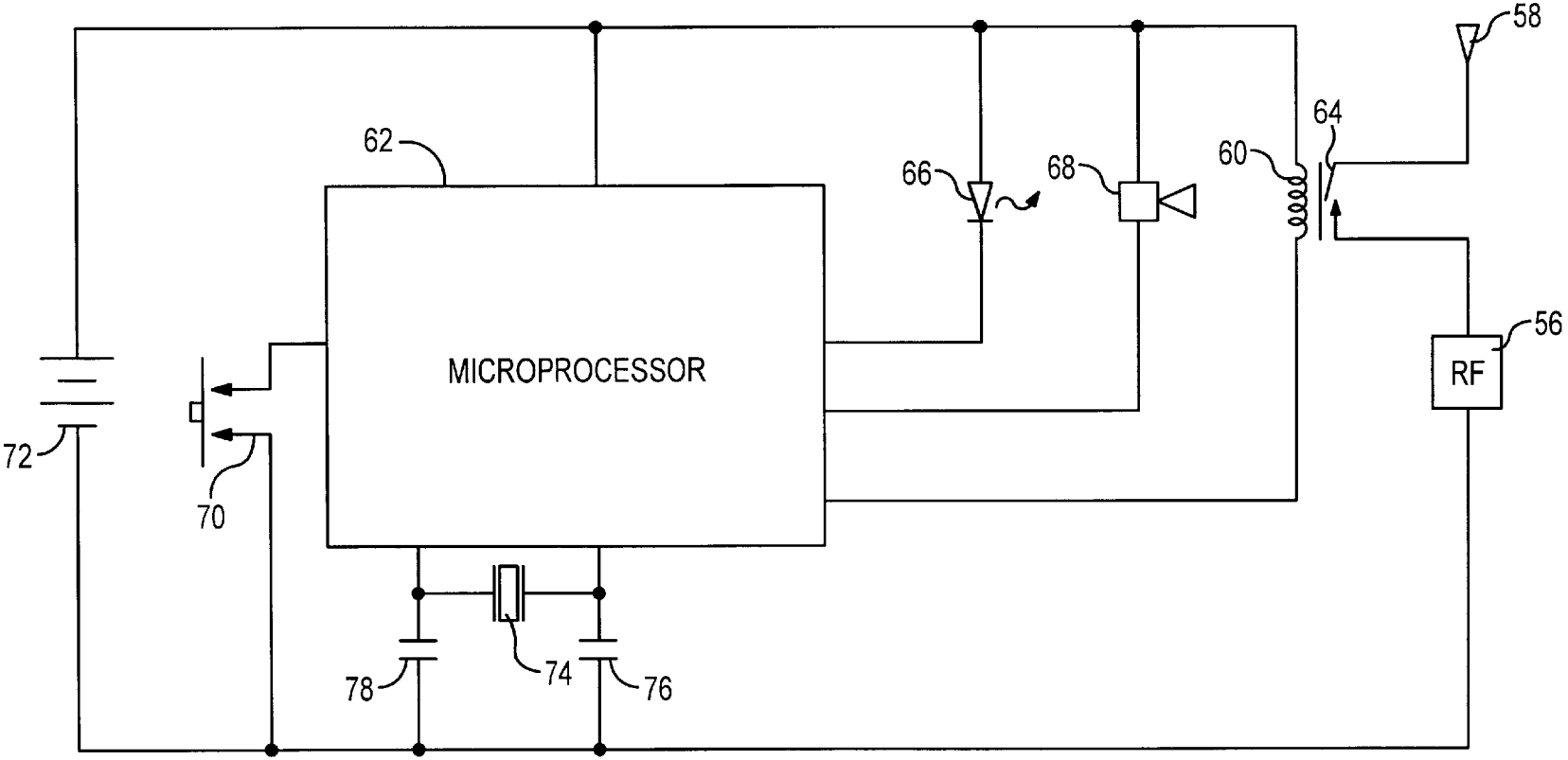
FIG. 4 is a schematic view of electrical components for a multi-event reminder device.

An alternative embodiment is shown in FIG. 4. This embodiment includes a radio frequency (RF) generator 56 that is connected to an antenna 58 by operation of a relay 60. A microprocessor 62 that may be identical to the microprocessor of FIG. 3 controls the relay 60. Thus, the microprocessor 62 may be programmed to track passing of a set time period. During this time period, the contact 64 of the relay 60 is in the open position, so that the antenna is isolated from the RF generator. However, upon expiration of the time period, the microprocessor generates a signal which activates the relay, thereby closing a contact 64. This connects the antenna to the RF generator in order to broadcast a signal which is received by a remote alert mechanism, not shown. The remote alert mechanism may be a light source, a source of an audible signal, or may be a device that generates some other type of human-perceivable alert.

In an alternative embodiment, all of the alert mechanisms are remotely located and are triggered by one or more RF generators. Thus, the reminder device does not include any internal alert mechanisms, such as LEDs or audio transducers. Optionally, RF communication with the reminder device may be bidirectional, so that the reminder device may be programmed wirelessly, rather than by means of a reset/program switch. Other wireless input mechanisms may also be used, e.g., a photosensor mounted to the reminder device to receive programming optical signals.

The microprocessor 62 of FIG. 4 is also connected to an LED 66 and an audio transducer 68. Consequently, the microprocessor may be programmed to simultaneously track three different time periods. In the same manner as the circuit of FIG. 3, the timer circuit of FIG. 4 includes a solitary reset/program switch 70, a 3 volt battery 72, and a crystal arrangement that includes a piezo crystal 74 and a pair of capacitors 76 and 78. Optionally, the timing circuit may include additional alert mechanisms without taxing the capabilities of the microprocessor. The timing circuit is configured to track multiple coincident or sequential time periods for each of the alert mechanisms, and to generate an alert when each of the time periods expires.

Figure 5:
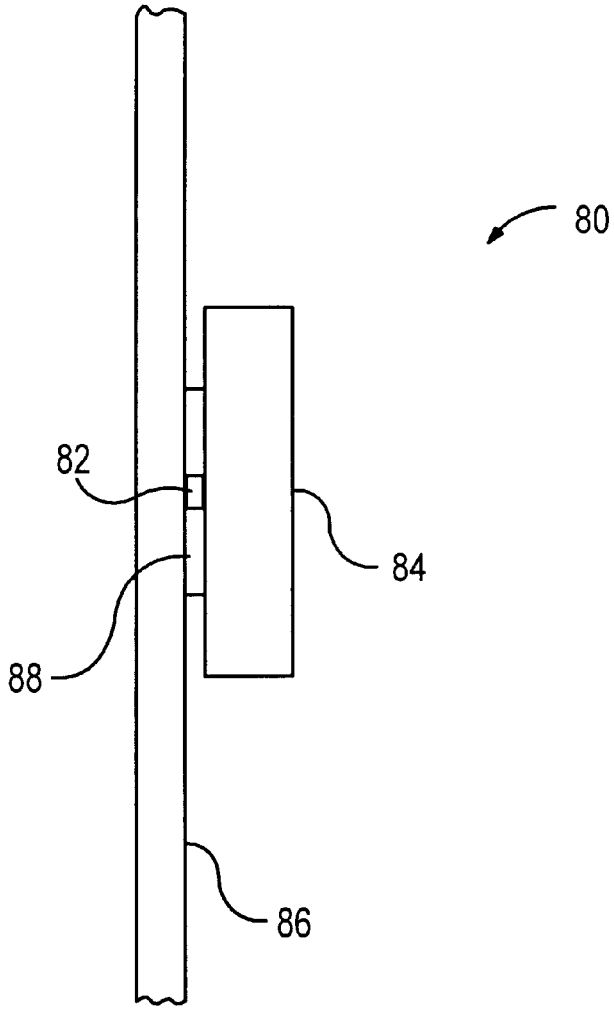
FIG. 5 is a side view of a second embodiment of a button-shaped reminder device in accordance with the invention.

FIG. 5 illustrates a second embodiment of the button-shaped reminder device 80. In this embodiment, the toggle switch 82 that is used for setting, resetting and programming the device is on a side that is opposite to the surface 84 that is exposed during use. That is, the switch 82 faces the mounting surface 86, which may be glass, plastic, a painted surface, or a metal surface. A magnetic or adhesive strip 88 is used to attach the reminder device 80 to the mounting surface 86. A user may apply pressure to the exposed face 84 of the reminder device in order to trigger the toggle switch 82. Therefore, the material used to form the strip 88 should be compressible. Alternatively, there may be a compliant intermediate material between the magnetic/adhesive strip 88 and the housing of the reminder device.

While not shown in FIG. 5, the button-shaped reminder device 80 includes at least one internal sensory alert that is connected to an electrical timer to generate a visible and/or audible alert upon expiration of at least one selected period of time. Preferably, the device may be used to provide reminders for a number of events, such as the pet-care events of administering heartworm medication, flea dips, household flea treatments, repellant pads, eye drops, and the like.

What is claimed is:

1. A reminder device comprising:

a button-shaped cylindrical housing having a face;

an electrical timer for tracking at least one selected period of time, said electrical timer being programmable;

a solitary two-state switch contained within said housing and positioned such that force applied to said face toggles said solitary two-state switch, said electrical timer being responsive to said solitary two-state switch for programming said electrical timer to identify a plurality of said selected periods of time, said solitary two-state switch and said electrical timer being cooperative such that said solitary two-state switch is the sole input device for entries in said programming said electrical timer to identify said plurality of said selected periods of time, said electrical timer being configured to enable said selected periods of time to have different start and end times that are separate and independent of start and end times of any other said selected period of time; and at least one sensory alert connected to said electrical timer to generate a human-perceptible alert upon expiration of said each selected period of time.

2. The reminder device of claim 1 wherein said electrical timer is programmed to provide multiple reminders related to different pet-care events.

3. The reminder device of claim 1 wherein said electrical timer is programmed to provide multiple reminders related to different automobile-care events.

4. The reminder device of claim 1 wherein said solitary two-state switch has a triggering mechanism on a side of said housing opposite to said face such that pressure applied to either of two opposite sides of said housing toggles said solitary two-state switch, said solitary two-state switch being the only input mechanism available to a user of said reminder device.

5. A reminder device comprising:

a portable housing having a face;

an electrical timer for tracking at least one selected period of time, said electrical timer being programmable;

a solitary two-state switch contained within said housing and positioned such that force applied to said face toggles said solitary two-state switch, said electrical timer being responsive to said solitary two-state switch as a sole source of entries for programming said electrical timer to identify a plurality of said selected periods of time, said electrical timer being configured to enable said selected periods of time to have different start and end times that are separate and independent of start and end times of any other said selected period of time, said plurality of selected periods of time being identified to provide multiple reminders related to different events; and at least one sensory alert connected to said electrical timer to generate a human-perceptible alert upon expiration of said each selected period of time.

6. The reminder device of claim 5 wherein said electrical timer is programmed to provide said multiple reminders related to different pet-care events.

7. The reminder device of claim 5 wherein said electrical timer is programmed to provide said multiple reminders related to different automobile-care events.

8. The reminder device of claim 5 wherein said solitary two-state switch has a triggering mechanism on a side of said housing opposite to said face such that pressure applied to either of two opposite sides of said housing toggles said solitary two-state switch, said solitary two-state switch being the only input mechanism available to a user of said reminder device.

* * * * *